US005511484A

United States Patent [19]

Theurer et al.

[11] Patent Number: 5,511,484

[45] Date of Patent: Apr. 30, 1996

[54] TRACK WORKING MACHINE

[75] Inventors: Josef Theurer, Vienna; Herbert Wörgötter, Gallneukirchen, both of Austria

[73] Assignee: Franz Plasser Bahnbaumaschinen-Industriegesellschaft m.b.H., Vienna, Austria

[21] Appl. No.: 290,395

[22] Filed: Aug. 15, 1994

[30] Foreign Application Priority Data

Sep. 17, 1993 [AT] Austria ..... 1890/93

[51] Int. Cl.[6] ..... E01B 29/00

[52] U.S. Cl. ..... 104/2; 104/5

[58] Field of Search ..... 104/2, 3, 5, 7.1–7.3, 104/12, 10, 15, 16, 17.1, 17.2

[56] References Cited

U.S. PATENT DOCUMENTS

| | | | |
|---|---|---|---|
| 4,272,664 | 6/1981 | Theurer | 219/53 |
| 4,878,435 | 11/1989 | Theurer | 104/2 |
| 4,955,302 | 9/1990 | Theurer et al. | 104/7.2 |
| 5,172,635 | 12/1992 | Theurer | 104/7.3 |
| 5,193,461 | 3/1993 | Theurer et al. | 104/7.1 |

FOREIGN PATENT DOCUMENTS 388001 4/1989 Austria .

*Primary Examiner*—Mark T. Le
*Attorney, Agent, or Firm*—Collard & Roe

[57] ABSTRACT

A track working machine comprises a machine frame extending in a longitudinal direction and having opposite ends, the machine frame having an upwardly recessed portion between the ends, and undercarriages supporting the machine frame ends on the track for mobility thereon in an operating direction. An operator's cab has an access below the upwardly recessed machine frame portion for permitting an operator to enter and leave the cab, and two structural parts are attached to the machine frame and extend in the longitudinal direction below the upwardly recessed machine frame portion, the structural parts being spaced from each other transversely to the longitudinal direction and defining therebetween a delimited working area. A hoisting apparatus is mounted on the machine frame, the hoisting apparatus comprising a load carrying device and drives for adjusting the load carrying device in vertical, longitudinal and transverse directions.

12 Claims, 2 Drawing Sheets

TRACK WORKING MACHINE

BACKGROUND OF THE INVENTION

1. Field of the Invention

The present invention relates to a track working machine comprising a machine frame extending in a longitudinal direction and having opposite ends, the machine frame having an upwardly recessed portion between the ends, undercarriages supporting the machine frame ends on the track for mobility thereon in an operating direction, and an operator's cab having an access below the upwardly recessed machine frame portion for permitting an operator to enter and leave the cab.

2. Description of the Prior Art

A mobile rail welding machine of this type is known from U.S. Pat. No. 4,272,664. This machine has a closed rail car body housing operator's cabs at both ends of the machine frame with access to a working area defined by an upwardly recessed machine frame portion between the machine frame ends. A vertically movable working platform forms the floor of the working area and extends in a longitudinal direction between the track rails. A flash butt welding device and a rail grind device are suspended on the upwardly recessed machine frame portion in the working area. To obtain the required free access to the rails from above, the working platform consists of a relatively narrow plank on which the operator stands during the operation.

Austrian patent No. 388,001 discloses an installation for handling assembled track sections, which comprises an elongated flat car whose loading platform serves as a working area for assembling and disassembling track sections. A crane is movable along guide rails on the machine frame for conveying ties and rails during the assembling and disassembling operation. The ties are stored on the flat car while the rails are stored on a freight car coupled to the flat car and conveyed to the working area by the crane.

U.S. Pat. No. 5,193,461 discloses a tie exchange machine with a machine frame having an upwardly recessed machine frame portion. The working tools comprising a tie exchange device and a tamping unit are housed in a working area below this machine frame portion. A crane with an adjustable boom runs atop the machine frame for conveying old ties away and new ties to the working area. The machine frame has an opening providing access to the working area for the ties being conveyed.

SUMMARY OF THE INVENTION

It is a primary object of this invention to provide a machine of the first-described type which has a simple structure assuring the safety of the operating personnel for carrying out various track work operations.

The above and other objects are accomplished in such a machine according to the invention with two structural parts attached to the machine frame and extending in the longitudinal direction below the upwardly recessed machine frame portion, the structural parts being spaced from each other transversely to the longitudinal direction and defining therebetween a delimited working area, and a hoisting apparatus mounted on the machine frame, the hoisting apparatus comprising a load carrying device and drive means for adjusting the load carrying device in vertical, longitudinal and transverse directions.

The combination of a secured working area delimited by the upwardly recessed machine frame portion and the two structural parts with the hoisting apparatus on the machine frame assures optimal safety for the operating personnel in this area during their work so that they are safe from surrounding dangers posed, for example, by traffic on a neighboring track. The working area may be accessed directly from the operator's cab and may be left swiftly, if desired, while assuring full freedom for carrying out required track work with the aid of the hoisting apparatus. The operating personnel can concentrate fully on the work without having to pay attention to high-speed traffic on a neighboring track, which may otherwise repeatedly interrupt their work.

If the two structural parts are spaced from each other a maximal distance within an area defined by a transverse section of the machine frame and one end of the structural parts extends to the access of the operator's cab, the operating personnel will be prevented from entering a potentially dangerous area outside the area defined by the transverse machine frame section.

The track structural parts are preferably railings detachably or pivotably mounted on the machine frame, which has the advantage that the working area may be enlarged to one side of the track if there is only one neighboring track to worry about simply by detaching or lifting the railing on that one side.

According to a preferred embodiment, the hoisting apparatus is a crane comprising a boom vertically adjustable by the drive means and pivotal about a vertical axis, the load carrying device being mounted on a free end of the boom. Guide rails may be mounted atop the machine frame and flanged rollers support the crane on the guide rails. The guide rails extend from one of the machine frame ends at least to the upwardly recessed machine frame portion above the delimited working area, and means may be provided for limiting the pivoting range of the boom about the vertical axis to a selected side of the track. The upwardly recessed machine frame portion preferably comprises two beams extending in the longitudinal direction, the beams being spaced from each other transversely to the longitudinal direction and defining therebetween an access opening for receiving the free boom end and the load carrying device mounted thereon. This enables the operating personnel in the work area to make optimal use of the hoisting apparatus for delivering material necessary for the track work without having to leave the safe work area.

According to another preferred embodiment, the operator's cab is mounted below the upwardly recessed machine frame portion at a distance from the undercarriages, the cab defining a rear end of the delimited working area in the operating direction, and the machine further comprises a tamping unit and a rail lifting unit, the tamping and rail lifting units being vertically adjustably mounted on the machine frame behind the cab in the operating direction. Trailers may be pivotally coupled to the machine frame ends and supported on the track by undercarriages, each one of the trailers carrying track working means and an operator's cab. A leading one of the trailers in the operating direction may carry a vertically adjustable ballast plow arrangement and has a loading platform, and a rear one of the trailers in the operating direction may carry a vibratory track stabilization unit and a vertically adjustable ballast broom. Advantageously, a loading platform is provided immediately adjacent the upwardly recessed machine frame portion. Such a machine may serve in a great variety of track work operations.

BRIEF DESCRIPTION OF THE DRAWING

The above and other objects, features and advantages of the present invention will become more apparent from the following detailed description of certain now preferred embodiments thereof, taken in conjunction with the accompanying partially schematic drawing wherein.

DETAILED DESCRIPTION OF THE PREFERRED EMBODIMENTS

Figure 1:
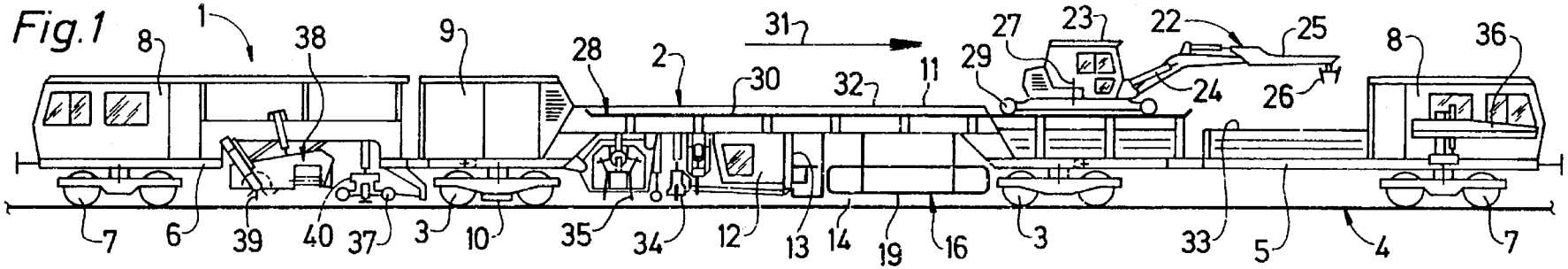
FIG. 1 is a side elevation showing one embodiment of a track working machine according to this invention.

Referring now to FIGS. 1 to 4, there is shown multi-functional track working machine 1 capable of carrying out a variety of track work operations. The machine comprises machine frame 2 extending in a longitudinal direction and having opposite ends, the machine frame having upwardly recessed portion 11 between the ends. Undercarriages 3, 3 support the machine frame ends on track 4 for mobility thereon in an operating direction indicated by arrow 31. Operator's cab 12 having access 13 at a front end of the cab below upwardly recessed machine frame portion 11 permits an operator to enter and leave the cab. At upwardly recessed machine frame portion 11, the underside of machine frame 2 is vertically spaced about two meters from the upper side of ties 15 of track 4.

Machine frame 2 carries central power source 9 delivering power to drive 10 for moving machine 1 along track 4 as well as to all other operating drives of the machine. In the illustrated embodiment, machine 1 further comprises trailers 5 and 6 pivotally coupled to the machine frame ends at their free ends and supported at their opposite ends on track 4 by undercarriages 7, 7. Each trailer carries track working means to be described hereinafter and an operator's cab 8.

Figure 4:
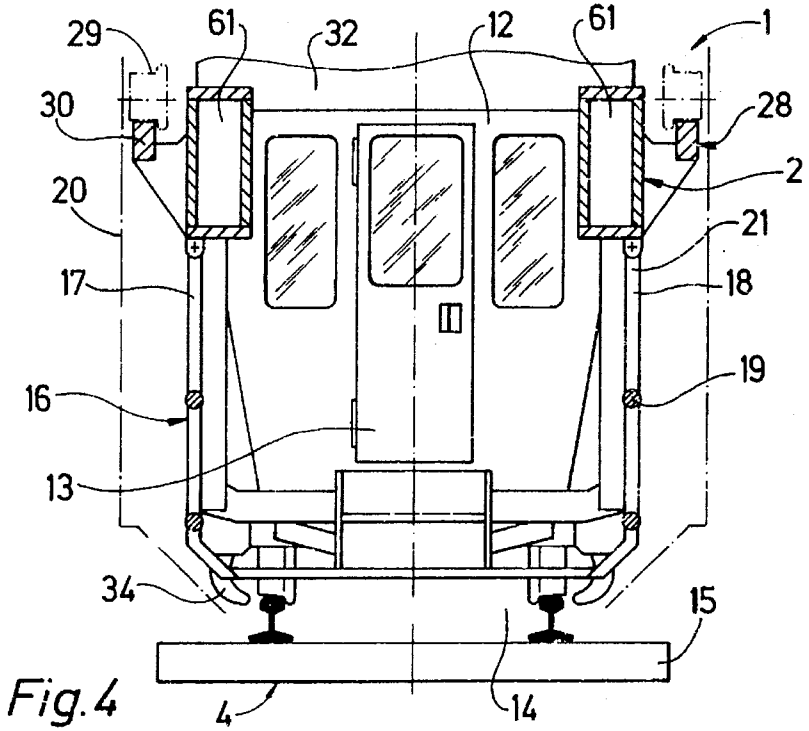
FIG. 4 is a sectional view of the machine, taken in the direction of arrow IV of FIG. 2.
Figure 2:
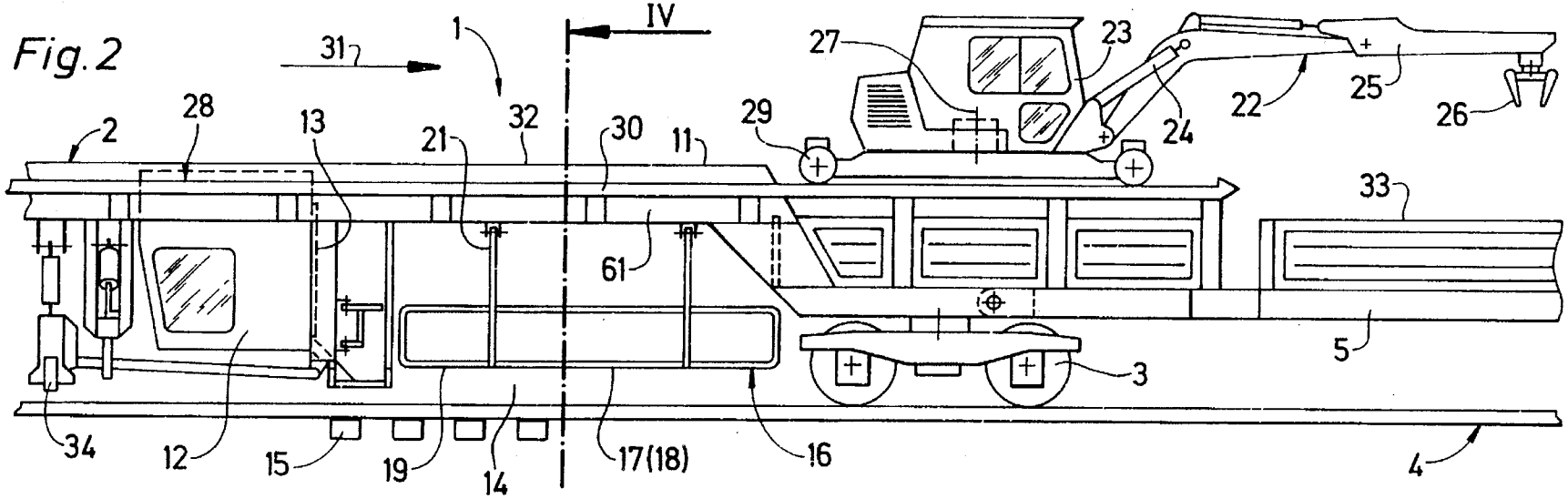
FIGS. 2 and 3 are, respectively, enlarged fragmentary side and top views showing the upwardly recessed machine frame portion and crane of the machine of FIG. 1.

As best shown in FIG. 4, two structural parts 17, 18 are attached to machine frame 2 and extend in the longitudinal direction below upwardly recessed machine frame portion 11, the structural parts being spaced from each other transversely to the longitudinal direction and constituting enclosure 16 defining therebetween delimited working area 14. Structural parts 17, 18 are spaced from each other a maximal distance within an area delineated by phantom lines 20 and defined by a transverse section of the machine frame, one end of the structural parts extending to access 13 of operator's cab 12 while the other end extends to front undercarriage 3 so that the entire working area 14 between cab 12 and the front undercarriage is secured by enclosure 16. In this way, operating personnel can enter or leave working area 14 only through access 13 of operator's cab 12. The structural parts comprise railings 19 detachably and/or pivotably mounted on machine frame 2 by vertical support rods 21, which hold railings 19 on the machine frame. If it is desired to widen working area 14, structural part 17 or 18 may be detached or pivoted upwardly. This may safely be done if there is a neighboring track only at one side of track 4 so that no safety measures are needed at the opposite side.

Machine 1 further comprises hoisting apparatus 22 mounted on machine frame 2, the hoisting apparatus comprising load carrying device 26 and drive 24 for adjusting the load carrying device in a vertical direction. The illustrated hoisting apparatus is a crane 23 comprising telescoping boom 25 vertically adjustable by drive 24, longitudinally adjustable by another drive and pivotal about vertical axis 27 for transverse adjustment. Load carrying device 26 is mounted on a free end of boom 25 so that it is vertically, longitudinally and transversely adjustable. Conventional blocking means (not shown) are preferably provided for limiting the pivoting range of boom 25 about vertical axis 27 to a selected side of track 4.

Figure 3:
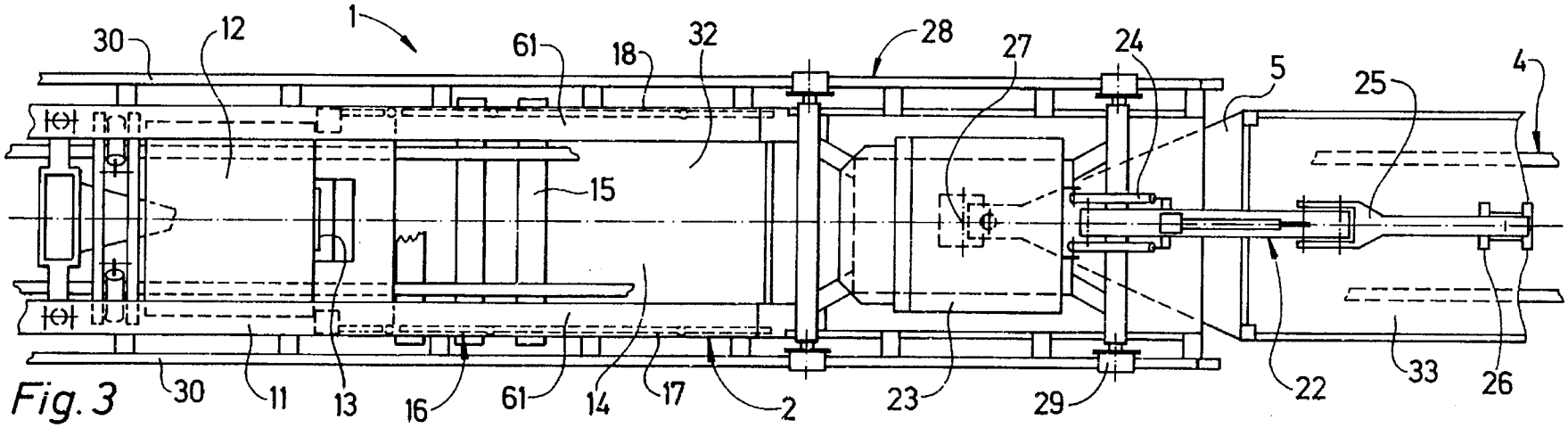

The track working machine further comprises two parallel guide rails 30 forming track 28 mounted atop machine frame 2 and flanged rollers 29 support crane 23 on guide rails 30. The guide rails extend from the front machine frame end at least to upwardly recessed machine frame portion 11 above delimited working area 14. As best shown in FIGS. 3 and 4, upwardly recessed machine frame portion 11 comprises two beams 61 extending in the longitudinal direction, the beams being spaced from each other transversely to the longitudinal direction and defining therebetween access opening 32 for receiving the free boom end and load carrying device 26 mounted thereon. In this way, the crane may deliver required material to the operating personnel in secured working area 14, and the workers need not leave this secured area during the track work. Loading platform 33 on front trailer 5 immediately adjacent upwardly recessed machine frame portion 11 is within the reach of the crane boom so that such required material may be stored there for delivery to working area 14 through access opening 32.

The operator's cab 12 is mounted below upwardly recessed machine frame portion 11 at a distance from undercarriages 3, 3 and the cab defines a rear end of delimited working area 14 in the operating direction. To enable machine 1 to be used for track correction operations, it further comprises tamping unit 35 and rail lifting unit 34, the tamping and rail lifting units being vertically adjustably mounted on machine frame 2 behind cab 12 in the operating direction.

The illustrated track working machine is equipped as a multi-functional machine, for which purpose leading trailer 5 in the operating direction carries vertically adjustable ballast plow arrangement 36 and has loading platform 33, and rear trailer 6 in the operating direction carries track stabilization unit 37 with vibratory drive 40 and vertically adjustable ballast broom 38 rearwardly thereof. The broom has rotary brush 39 for sweeping any ballast from ties 15 at the end of the work.

Figure 5:
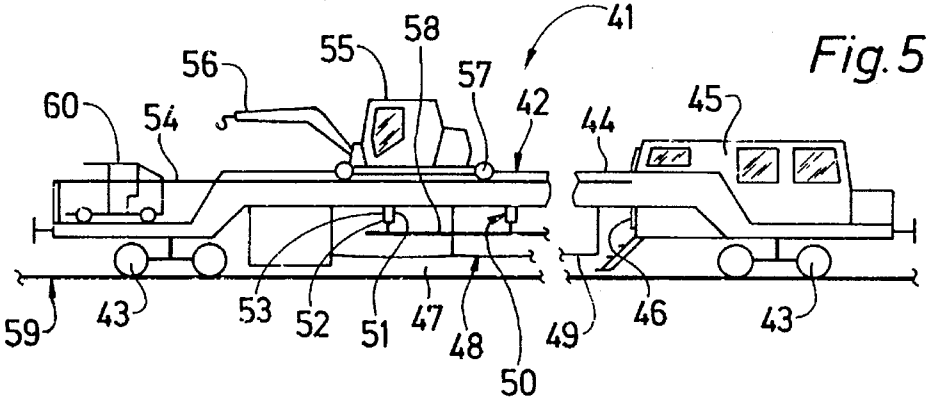
FIG. 5 is a fragmentary side elevation showing another embodiment of the track working machine.

Track working machine 41 shown in FIG. 5 is useful for preparatory work for rail welding operations. The machine comprises a bridge-like machine frame 42 whose opposite ends are supported on track 59 by undercarriages 43, 43. The machine frame has upwardly recessed elongated machine frame portion 44 between the machine frame ends, operator's cab 45 being mounted on the machine frame at one end thereof, adjacent the upwardly recessed machine frame portion. Cab 45 has access 46 below upwardly recessed machine frame portion 44 for permitting operators to enter and leave working area 47 therebelow through cab 45. Enclosure 48 comprising two structural parts consisting of tensioned ropes 49 are attached to machine frame 42 and extend in the longitudinal direction below upwardly recessed machine frame portion 44, the tensioned ropes being spaced from each other transversely to the longitudinal direction and defining therebetween delimited working area 47. Hoisting apparatus 50 comprised of a plurality of tackles 51 is mounted on the machine frame, the hoisting apparatus comprising load carrying device 52 mounted on the tackles and drives 53 for adjusting the load carrying device in a vertical direction. The tackles are adjustable in longitudinal and transverse directions by guides (not shown) on the machine frame.

A further hoisting apparatus comprised of crane 55 is mounted atop machine frame 42 and supported by flanged rollers 57 on two guide rails 54. The crane has vertically adjustable boom 56 which may place lengths of rails 58 through an access opening in the machine frame in secured working area 47 where operating personnel may accurately position the lengths of rails in track 59 by means of hoisting device 50. A spike driving or bolt screwing machine 60 may be carried on machine frame 42 and may also be placed by crane 55 in working area 47 where it may be used to fasten the welded rails to the ties. Cab 45 may be large enough to serve not only as an operating room during work but also as a leisure room enabling the operating personnel to spend time during rest periods or as an eating room.

What is claimed is:

1. A track working machine comprising (a) a machine frame extending in a longitudinal direction and having opposite ends, (1) the machine frame having an upwardly recessed portion between the ends, (b) undercarriages supporting the machine frame ends on the track for mobility thereon in an operating direction, (c) two structural barrier parts attached to the machine frame and extending in the longitudinal direction below the upwardly recessed machine frame portion, the structural parts being spaced from each other transversely to the longitudinal direction and defining therebetween a delimited working area, (d) an operator's cab having an access directly to and from the working area below the upwardly recessed machine frame portion for permitting an operator to enter and leave the cab, and (e) a hoisting apparatus mounted on the machine frame, the hoisting apparatus comprising (1) a load carrying device and (2) drive means for adjusting the load carrying device in vertical, longitudinal and transverse directions.

2. The track working machine of claim 1, wherein the two structural barrier are spaced from each other a maximal distance within an area defined by a transverse section of the machine frame, one end of the structural parts extending to the access of the operator's cab.

3. The track working machine of claim 1, wherein the structural barrier are railings detachably mounted on the machine frame.

4. The track working machine of claim 1, wherein the structural barrier comprise railings pivotably mounted on the machine frame.

5. The track working machine of claim 1, wherein the hoisting apparatus is a crane comprising a boom vertically adjustable by the drive means and pivotal about a vertical axis, the load carrying device being mounted on a free end of the boom.

6. The track working machine of claim 5, further comprising guide rails mounted atop the machine frame and flanged rollers supporting the crane on the guide rails.

7. The track working machine of claim 6, wherein the guide rails extend from one of the machine frame ends at least to the upwardly recessed machine frame portion above the delimited working area.

8. The track working machine of claim 5 wherein the upwardly recessed machine frame portion comprises two beams extending in the longitudinal direction, the beams being spaced from each other transversely to the longitudinal direction and defining therebetween an access opening for receiving the free boom end and the load carrying device mounted thereon.

9. The track working machine of claim 1, wherein the operator's cab is mounted below the upwardly recessed machine frame portion at a distance from the undercarriages, the cab defining a rear end of the delimited working area in the operating direction, and further comprising a tamping unit and a rail lifting unit, the tamping and rail lifting units being vertically adjustably mounted on the machine frame behind the cab in the operating direction.

10. The track working machine of claim 1, further comprising trailers pivotally coupled to the machine frame ends and supported on the track by undercarriages, each one of the trailers carrying track working means and an operator's cab.

11. The track working machine of claim 10, wherein a leading one of the trailers in the operating direction carries a vertically adjustable ballast plow arrangement and has a loading platform, and a rear one of the trailers in the operating direction carries a vibratory track stabilization unit and a vertically adjustable ballast broom.

12. The track working machine of claim 1, comprising a loading platform immediately adjacent the upwardly recessed machine frame portion.

* * * * *